US007137332B2

(12) United States Patent
Iizuka

(10) Patent No.: US 7,137,332 B2
(45) Date of Patent: Nov. 21, 2006

(54) ACTUATOR

(75) Inventor: Hiromichi Iizuka, 11-7, Hirasaku 2-chome, Yokosuka-shi, Kanagawa-ken (JP)

(73) Assignees: Asahi Enterprise Co., Ltd., Tokyo (JP); Hiromichi Iizuka, Yokosuka (JP); Eizo Maeda, Tokyo (JP)

( * ) Notice: Subject to any disclaimer, the term of this patent is extended or adjusted under 35 U.S.C. 154(b) by 0 days.

(21) Appl. No.: 11/226,439

(22) Filed: Sep. 15, 2005

(65) Prior Publication Data

US 2006/0086246 A1 Apr. 27, 2006

(30) Foreign Application Priority Data

Oct. 21, 2004 (JP) ..... 2004-307388

(51) Int. Cl.
*F01B 19/00* (2006.01)

(52) U.S. Cl. ..... 92/101; 92/98 R

(58) Field of Classification Search ..... 92/96, 92/97, 98 R, 101, 129, 140
See application file for complete search history.

(56) References Cited

U.S. PATENT DOCUMENTS 5,410,207 A * 4/1995 Miura et al. ..... 310/328
5,927,177 A * 7/1999 Hochhalter ..... 92/98 R
6,286,413 B1 * 9/2001 Hochhalter ..... 92/101

* cited by examiner

*Primary Examiner*—Michael Leslie
(74) *Attorney, Agent, or Firm*—Manabu Kanesaka

(57) ABSTRACT

An actuator is provided to generate an ultrafine stroke according to a fluid input pressure such as air pressure or the like. A throughhole 12 is formed in a center part of a body 10 so as to traverse a body 10 having plural notches 21–24 formed vertically on the body, a depression 13 is formed at the end of the body 10, and a rod 17 connected with a pressure plate 16 housed and held in the depression 13 is disposed in this throughhole 20. When an input pressure is applied to the pressure plate 16 via a diaphragm 19, an output point P generates a stroke due to the elastic deformation of a join part at the end of the notches 21–24.

6 Claims, 6 Drawing Sheets

ACTUATOR

BACKGROUND OF THE INVENTION AND RELATED ART STATEMENT

This invention relates to an actuator, in particular an actuator to which a pressure is input and a displacement according to the input pressure is extracted.

A piezo actuator or bellows actuator has been proposed as a nanoactuator in which ultrahigh precision positioning is possible so that a minute, high precision displacement can be extracted.

A piezo actuator is a piezoelectric element which is polarized in a predetermined direction, and extracts a displacement using a distortion deformation by applying a voltage to this piezoelectric element. On the other hand, a bellows actuator is an actuator wherein positional control is performed by feedback of a force applied to a bellows and a distortion amount of the bellows due to this force.

In a prior art piezoactuator, since there is a large amount of hysteresis, closed loop control must be performed. Also, since the piezoactuator has a high development cost, it is limited to applications which assume mass production or applications where high cost can be tolerated, and it cannot be used for applications which do not assume mass production or low-cost applications. Moreover, with a piezoactuator, if the applied voltage is not increased, a large displacement amount cannot be extracted.

On the other hand, in the case of a bellows actuator, since the distortion amount determines the displacement amount, temperature drift increases. Also, it is easily affected by external noise, closed loop control is indispensable for increasing precision, and it is difficult to manufacture it at low cost.

SUMMARY OF THE INVENTION

It is therefore an object of the present invention to provide an actuator which permits ultrafine positioning.

It is a further object of the present invention to provide an actuator with small hysteresis which can be used easily even in an open loop.

It is still another object of the present invention to provide an actuator which has a low development cost, and which can be used in applications which do not assume mass production or applications which demand low cost.

It is still another object of the present invention to provide an actuator wherein a position is determined by a balance of pressures such as air pressure or the like, which has a small temperature drift, and which is not easily affected by external noise.

It is yet another object of the present invention to provide an actuator which can maintain high precision even in an open loop by incorporating a position sensor which detects a displacement due to a pressure such as air pressure or the like.

The aforesaid object and other objects of the invention will become apparent from the technical concept of the invention and its embodiment described below.

The present invention of this application relates to an actuator, comprising:

a body having a throughhole with an abutting tip, a notch formed to cut across the throughhole, and a depression communicating with the base end of the throughhole, a pressure plate housed and supported in the depression, a rod installed in the pressure plate and inserted into the throughhole, a diaphragm sealing the depression so that is in contact with an opposite end face relative to an end face on which the rod of the pressure plate is provided, and a nozzle installed in a communicating part with the depression of the throughhole so that the end face of the pressure plate on which the rod is installed, acts as a flapper, wherein:

a tip side part of the throughhole of the body displaces due to an elastic deformation of the notch part when an input pressure is applied to the pressure plate via the diaphragm while a supply pressure is being applied to the interior of the depression.

The depression sealed by the diaphragm may be further covered by a cover body. Further, a disk spring may be disposed so that it is superimposed on the diaphragm, an elastic restoring force in the axial direction of the rod being generated by this disk spring. Still further, plural notches may be formed in the body, the plural notches on both sides in the axial direction relative to the midpoint of the rod being in a mutually symmetrical positional relationship so that displacements in a direction which intersects with the axial direction of the rod cancel each other out. Still further, an even number of notches may be formed in the body, and a displacement in the axial direction of the rod is extracted. Alternatively, an odd number of notches may be formed in the body, and the rotational displacement due to turning in a part containing one or more of these plural notches is extracted.

According to the essential invention of this application, there is provided a body having a throughhole with an abutting tip, a notch formed to cut across the throughhole, and a depression communicating with the base end of the throughhole, a pressure plate housed and supported in the depression, a rod installed in the pressure plate and inserted into the throughhole, a diaphragm sealing the depression so that is in contact with an opposite end face relative to an end face wherein the rod of the pressure plate is provided, and a nozzle installed in a communicating part with the depression of the throughhole so that the end face of the pressure plate on which the rod is installed, acts as a flapper, wherein a tip side part of the throughhole of the body displaces due to an elastic deformation of the notch part when an input pressure is applied to the pressure plate via the diaphragm while a supply pressure is being applied to the interior of the depression.

Therefore, according to such an actuator, when an input pressure is applied to the pressure plate via the diaphragm on the opposite side of the pressure plate, the rod installed in the pressure plate displaces in an axial direction through the throughhole and its tip part presses the abutting part of the body in contact with it, so the body elastically deforms in the notch part and the tip side part of the throughhole displaces. Therefore, a displacement corresponding to the pressure applied to the diaphragm can be extracted, and an actuator which is capable of fine positioning can be provided.

DETAILED DESCRIPTION OF PREFERRED EMBODIMENTS

Figure 1:
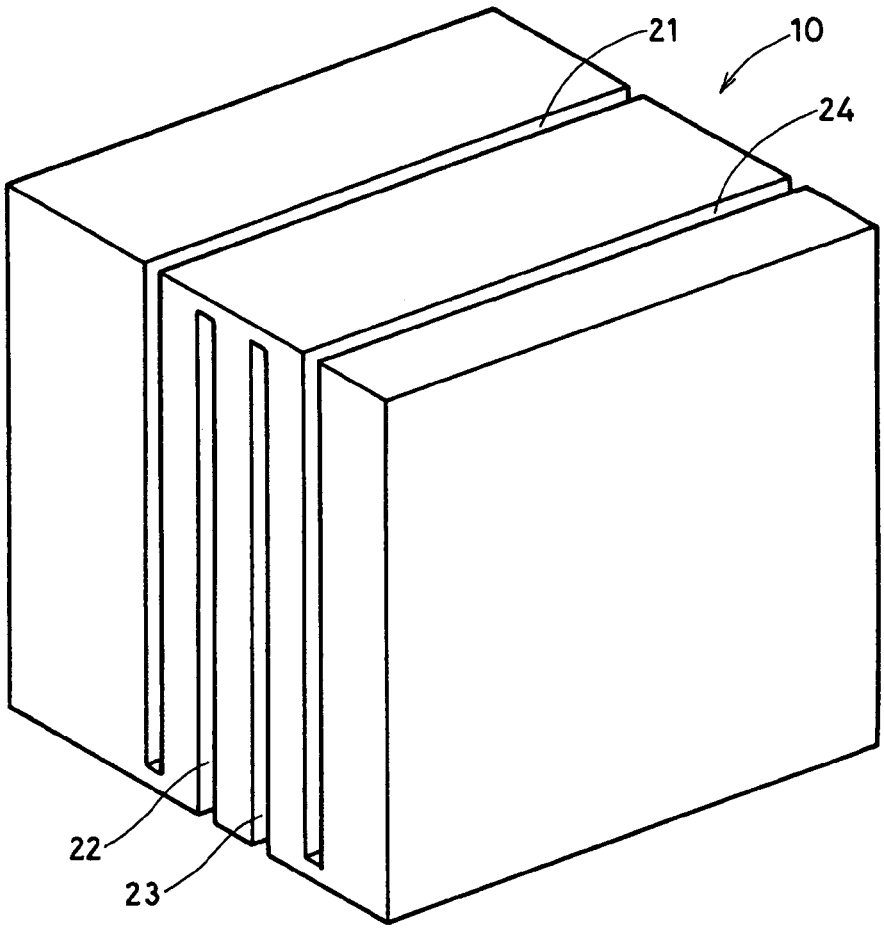
FIG. 1 is a perspective view showing the external appearance of the body of an actuator.
Figure 2:
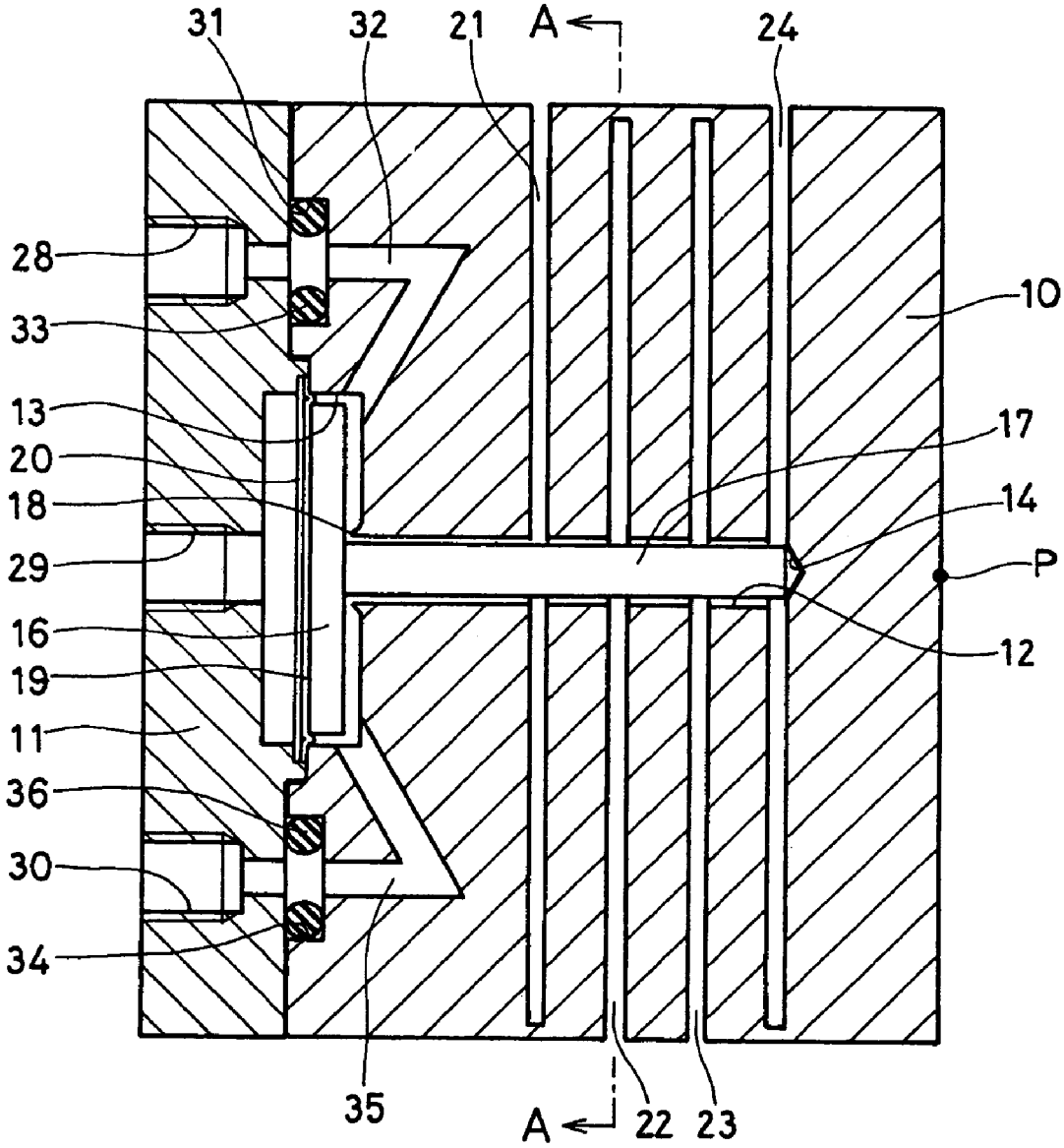
FIG. 2 is a vertical sectional view of the actuator.

An embodiment of the invention will now be described referring to the drawings. FIG. 1 to FIG. 4 show an actuator according to this embodiment, the actuator comprising a body 10 having an essentially cubic shape as shown in FIG. 1. The body 10 may be made of for example stainless steel, carbon steel or aluminium alloy. As shown in FIG. 2, a cover body 11 likewise of stainless steel or carbon steel is attached to one end side of the body 10. As shown in FIG. 2, a throughhole 12 passes through the center part of the body 10 in a horizontal direction. A circular depression 13 is formed in a base end part of the throughhole 12. This depression 13 is open at one end of the body 10. On the other hand, the tip part of the throughhole 12 forms a contact abutting part 14.

Within the circular depression 13, a pressure plate 16 which is a circular plate one order of magnitude smaller than this circular depression 13, is disposed. A rod 17 is installed in this pressure plate 16 so that it projects forwards from one end thereof. The tip part of this rod 17 comes in contact with the aforesaid contact abutting part 14, and presses the contact abutting part 14. A nozzle 18 is formed integrally in a communicating part with the depression 13 of the throughhole 12 opposite the end face of the pressure plate 16 onto which the rod 17 of the pressure plate 16 projects.

A diaphragm 19 is installed so as to press the pressure plate 16 on the end on the opposite side to the end on which the rod 17 projects. A disk spring 20 is installed above the diaphragm 19. The cover body 11 is installed on the end of the body 10 so that the cover body 11 closes the depression 13.

Figure 3:
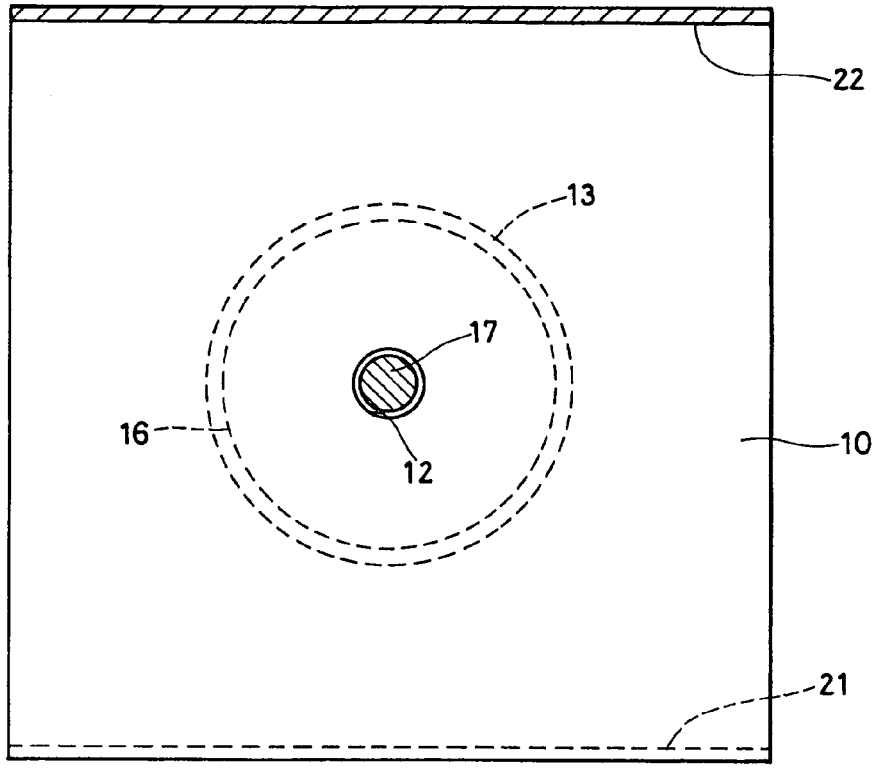
FIG. 3 is a sectional view through a line A—A in FIG. 2.

Four notches 21, 22, 23, 24 are formed perpendicularly to the axial direction of the throughhole 12 in the body 10 (FIG. 3). Here, the notches 21, 24 are formed from top to bottom of the body 10, so that only a lower part of very small thickness, e.g. 0.3 mm, is joined. On the other hand, the two notches 22, 23 in the middle are formed from bottom to top, so that only a very small upper part having a thickness of, e.g. 0.3 mm, is joined.

A supply port 28, input port 29 and output ports 30 are respectively formed in the cover body 11. The supply port 28 communicates with the depression 13 from a passage 32 via a depression 31 of the body 10. An O-ring 33 fits up the interior of the depression 32. The output port 30 is provided so that it communicates with a depression 34 of the body 10, the depression 34 communicating with the depression 13 via a passage 35. An O-ring 36 fits up the depression 34.

Figure 4:
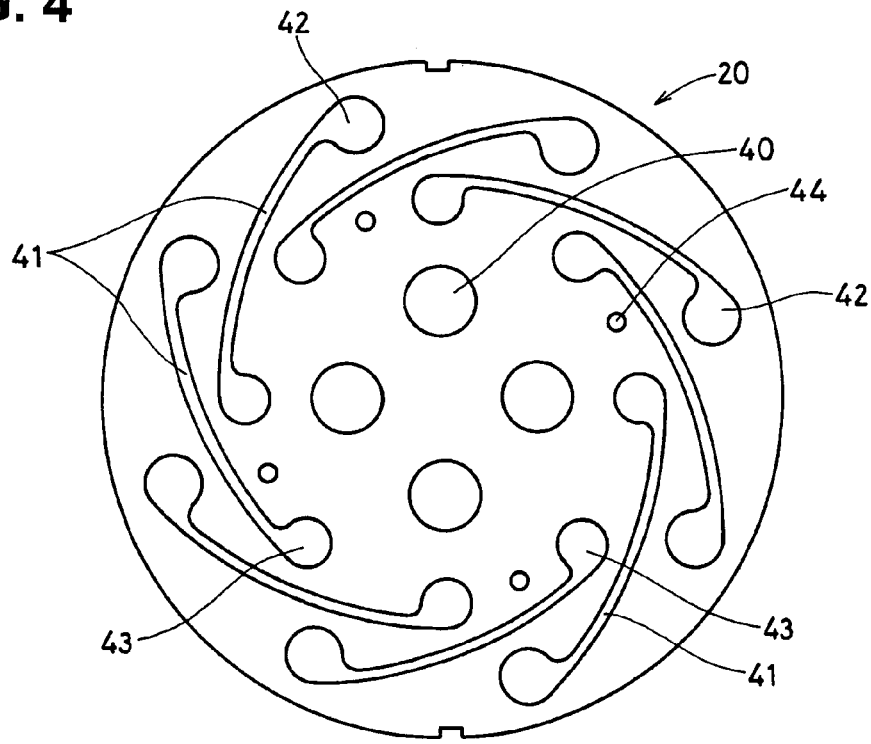
FIG. 4 is an enlarged front plan view of a disk spring.

Next, the disk spring 20 which is superimposed on the diaphragm 19 is manufactured from phosphor bronze plate. As shown in FIG. 4, four circular holes 40 are formed at 90° intervals in its center, and arc-shaped slits 41 are formed on a slant on its outside. These arc-shaped slits 41 respectively have widened parts 42, 43 at their two ends. The disk spring 20 has plural small holes 44 which are substantially concentric with the wide parts 43 in the center side of the slits 41.

Next, the operation of this actuator having the aforesaid construction will be described. A supply pressure is supplied to the interior of the depression 13 of the body 10 via the depression 31 and passage 32 from the supply port 28 of the cover 11 shown in FIG. 2. At the same time, a signal pressure is supplied from the input port 29, and the signal pressure or input pressure is applied from left to right of the diaphragm 19 which is superimposed on the disk spring 20. Therefore, the pressure plate 16 receives a pressure towards the right-hand side according to the input pressure via the diaphragm 19.

On the other hand, a nozzle flapper is formed by the pressure plate 16 and nozzle 18, and the supply pressure supplied via the passage 32 presses the pressure plate 16 and diaphragm 19 towards the left-hand side. The pressure plate 16 and nozzle 18 comprise a gap sensor or position sensor. The supply pressure then escapes outside the body 10 through the throughhole 12 and notches 21–24 according to the gap between the pressure plate 16 and nozzle 18. The gap between the nozzle 18 and pressure plate 16 is determined so that the pressing force in the left-hand direction due to the nozzle flapper and the pressing force in the right-hand direction due to the input pressure are balanced. Therefore, the rod 17 displaces in the axial direction inside the throughhole 12 accordingly, and its tip part presses the contact abutting part 14. Consequently, the part containing the notches 21–24 of the body 10 suffers a predetermined angular deformation, and a displacement point P on the right-hand side of the body 10 displaces in the axial direction. This displacement is therefore extracted as an output. As shown in FIG. 3, the rod 17 is inserted into the throughhole 13 leaving a gap, so the rod 17 does not cause hysteresis due to the throughhole 12.

Next, the aforesaid positioning action will be described by means of equations. The dimensions are set as follows:

$P_{in}$ input pressure
$P_{out}$ output pressure
$P_s$ supply pressure
D diameter of diaphragm 19
S effective surface area of diaphragm 19
d diameter of nozzle 18
s (small letter) effective surface area of nozzle 18
$d_0$ diameter of orifice (passage 32)
K spring constant due to notches 21–24 of body 10
k (small letter) spring constant of disk spring 20

The equilibrium balance of forces in the horizontal direction when the displacement point P at the right-hand end side of the body 10 displaces by $L_x$, will now be considered. The force $F_1$ acting in the right-hand direction is:

$$F_1=P_{in}\cdot S+k(X_0-L_x) \tag{1}$$

The force $F_2$ acting in the left-hand direction is:

$$F_2=P_{out}\cdot(S-s)+K\cdot L_x \tag{2}$$

Here, since $F_1=F_2$, $$P_{in}\cdot S+k(X_0-L_x)=P_{out}\cdot(S-s)+K\cdot L_x \tag{3}$$

Therefore, $$P_{out}=P_{in}\cdot S/(S-s)+k(X_0-L_x)/(S-s)-K\cdot L_x/(S-s) \tag{4}$$

On the right-hand side of Equation (4), the first term is a force equilibrium term due to the input pressure $P_{in}$, the second term is a term due to the force generated by the disk spring 20, and the third term is a term due to the elastic deformation of the part containing the notches 21–24 of the body 10. Now, assuming r=S/(S−s), if the second and third terms of Equation (4) are small:

$$P_{out}=r\cdot P_{in} \tag{5}$$

Since the air passage amounts in the orifice 32 and the nozzle 18 are equal, $$\sqrt{(P_s-P_{out})}\cdot\pi d_0^2/4=\pi d\cdot(X_o-L_x)\cdot\sqrt{P_{out}} \quad (6)$$

Therefore, $X_o-L_x=d_0^2\sqrt{(P_s-P_{out})}/4d\sqrt{P_{out}}$ (7)

and therefore, $X_o-L_x=d_0^2\sqrt{(P_s-rP_{in})}/4d\sqrt{rP_{in}}$ (8)

Hence, the displacement amount $L_x$ of the point P may be expressed as a function of the input pressure $P_{in}$. Thus, the variation amount of the output relative to the input, i.e., the span, is determined by $d_0^2/d$ as is clear from Equation (8). Now, if $d_0$=0.15 mm φ, $P_s$=500 kPa, $P_{in}$=10–400 KPa, d=4 mm φ, r=0.98, the span $d_0^2/d$ is 0.0092 mm, i.e., 9.2 μm.

Likewise, if $d_0$=0.6 mm φ, $P_s$=500 kPa, $P_{in}$=10–400 KPa, d=4 mm φ, r=0.98, the span $d_0^2/d$ is 0.1473 mm.

Hence, the setting precision of the output pressure $P_{out}$ relative to the input pressure $P_{in}$ is equal to 1/5000 or more, and the positional resolution which is the output stroke, is a similar value. When this value is applied to the aforesaid span, in the first example it is 1.8 nm and in the second example it is 29 nm.

In the actuator of this embodiment, since the setting precision is determined by the diameter $d_0$ of the orifice, diameter d of the nozzle, and surface area ratio S/(S−s) or r, the design is extremely simple. Further since positional adjustment is determined by the supply pressure $P_s$ and input pressure $P_{in}$, very simple control can be performed. Also, since hysteresis is small, the actuator can be used in an open loop. Since development cost is low, the actuator is fully compatible with applications which do not assume mass production and applications which demand low cost. Still further, since the position is determined by the balance of a fluid pressure such as air pressure or the like, temperature drift is small, and the actuator is not easily affected by external noise. Further, the actuator incorporates a position sensor due to the air pressure comprising a gap sensor formed by the pressure plate 16 and nozzle 18, so a high positional precision can be ensured even in an open loop.

This actuator thus has wide application, for example in positioning the focus of an electron microscope, adjusting the focus of a lens in the stepper of a semiconductor device, or positioning an egg in artificial fertilization.

Figure 5:
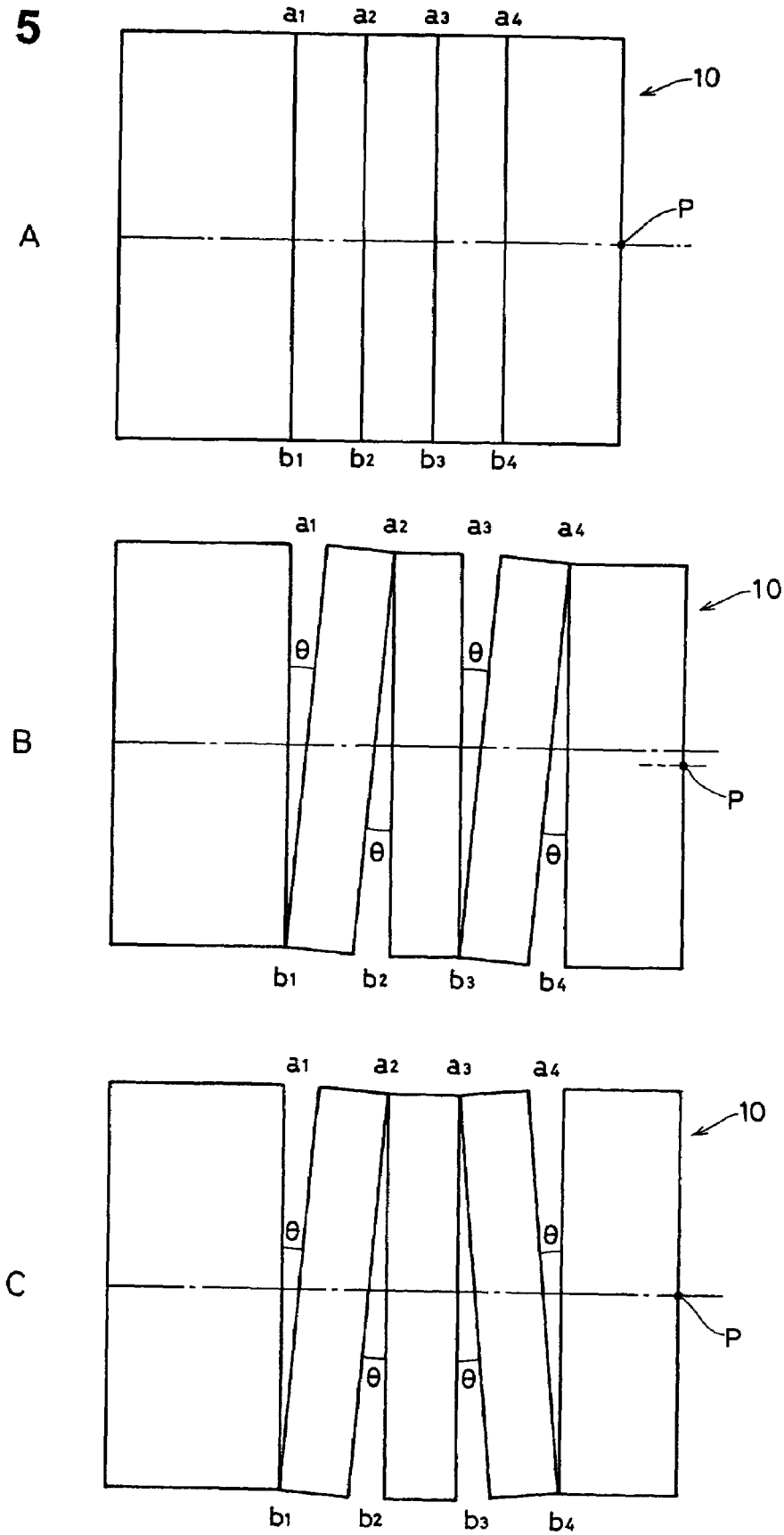
FIG. 5 is a lateral view of essential parts showing a deformation state according to the position of notch fulcrums.
Figure 6:
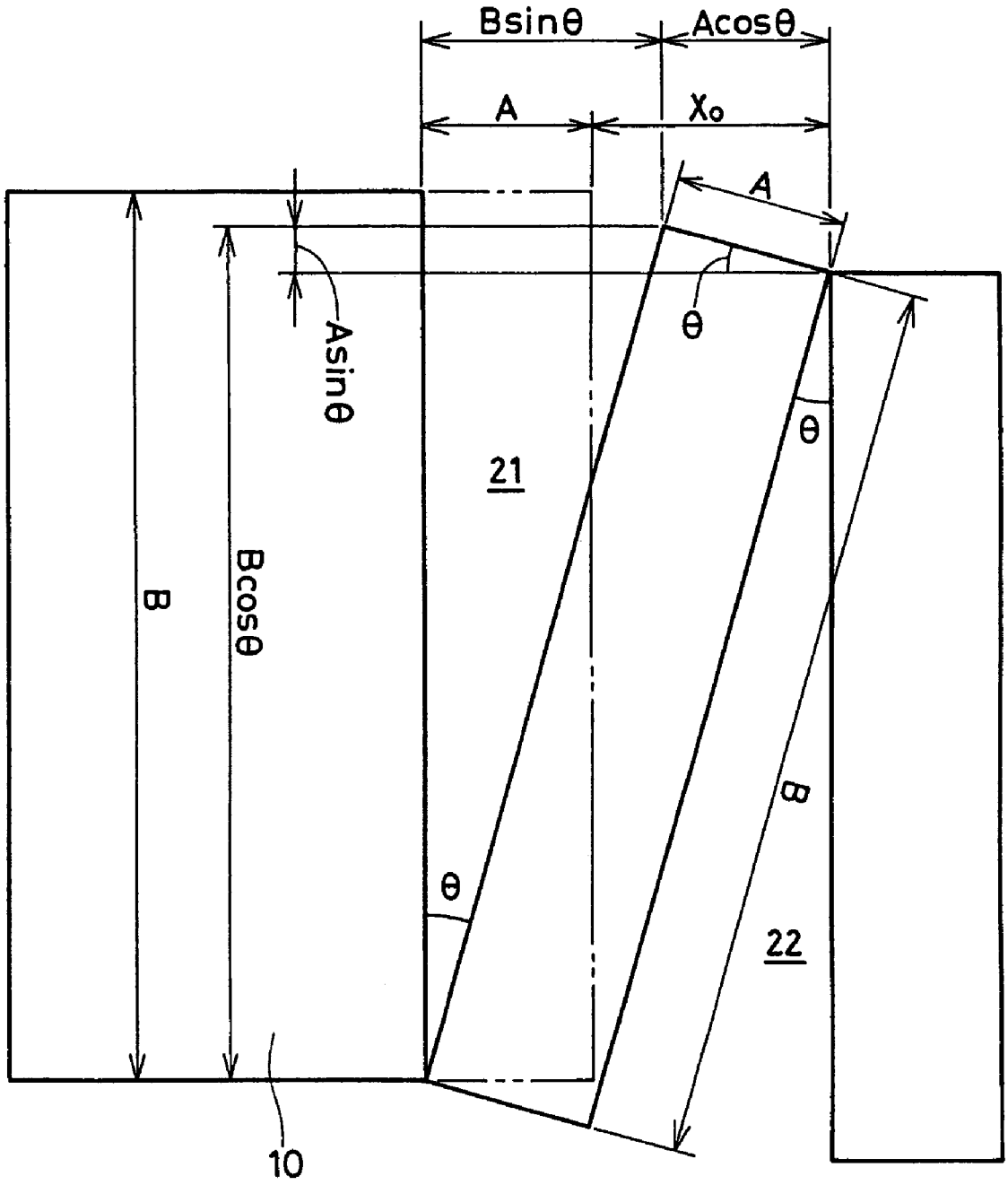
FIG. 6 is a lateral view for the purpose of calculating a displacement amount in the same deformation state.

The relation between the direction of the notches 21–24 of the body 10 and displacement will now be described referring to FIG. 5 and FIG. 6. First, as shown in FIG. 5B, the notches 21–24 are formed alternately, and if $b_1$, $a_2$, $b_3$, $a_4$ are respectively fulcrums of deformation, the displacement amount $X_0$ in the X-axis direction of the fulcrum $a_2$, as is clear from FIG. 6, is:

$$X_0=B\sin\theta+A\cos\theta-A=B\sin\theta-A(1-\cos\theta) \quad (9)$$

On the other hand, the displacement amount in the Y axis direction of the fulcrum $a_2$ is:

$$Y_0=-B+B\cos\theta-A\sin\theta=-B(1-\cos\theta)-A\sin\theta \quad (10)$$

The displacement amount in the X-axis direction of the displacement point P in FIG. 5B is twice the displacement amount of the fulcrum $a_2$, so the displacement amount X of the displacement point P is:

$$X=2(B\sin\theta-A(1-\cos\theta)) \quad (11)$$

On the other hand, the displacement amount in the Y direction of the displacement point P is twice the displacement amount in the same direction of the fulcrum $a_2$, so:

$$Y=-2(B(1-\cos\theta)-A\sin\theta)) \quad (12)$$

On the other hand, in FIG. 5C, the displacement amount in the X-axis direction and Y axis direction of the displacement point P is computed when the fulcrums on both sides of the midpoint in the length direction of the rod 17 are symmetrical with respect to each other, and $b_1$, $a_2$, $a_3$, $b_4$ are fulcrums. The displacement amount in the X axis direction of the fulcrum $a_2$ is identical to the displacement amount in the X axis direction of the fulcrum $a_2$ shown in FIG. 5B, and since it is identical to the case shown in FIG. 6, it can be expressed by Equation (9). Further, since the displacement amount in the Y axis direction of the fulcrum $a_2$ is equal to the displacement amount in the same direction of the fulcrum $a_2$ in FIG. 5B, it can be expressed by Equation (10).

Next, since the displacement amount in the X-axis direction of the displacement point P is identical to the displacement amount of the point P in FIG. 5B, it can be expressed by Equation (11). On the other hand, the displacement amount in the Y axis direction of the displacement point P is:

$$Y=-B(1-\cos\theta)-A\sin\theta+B(1-\cos\theta)+A\sin\theta=0 \quad (13)$$

As is clear from the above equation (13), if the arrangement of the fulcrums of the body 10, as shown in FIG. 5C, are disposed symmetrically to the left and right on both sides of the midpoint in the axial direction of the rod 17, the displacement amounts due to the fulcrums in the Y axis direction, i.e., a direction perpendicular to the stroke direction, cancel each other out so that the displacement amount of the point P can be set to 0. Therefore, the displacement in the Y axis direction can be eliminated.

Figure 7:
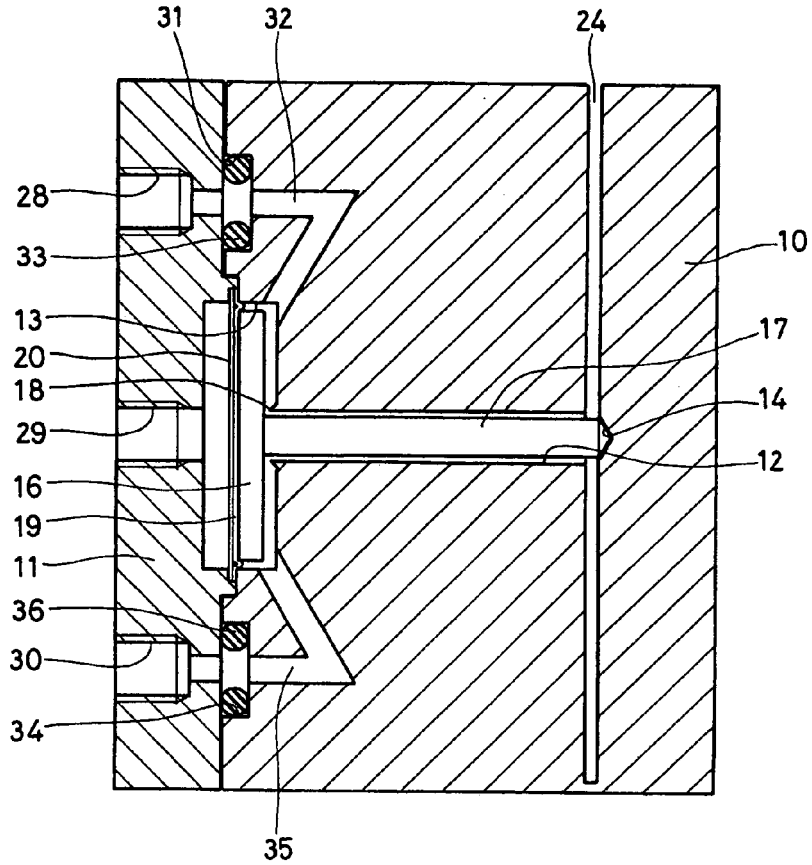
FIG. 7 is a vertical sectional view of this aspect applied to a rotating actuator.
Figure 8:
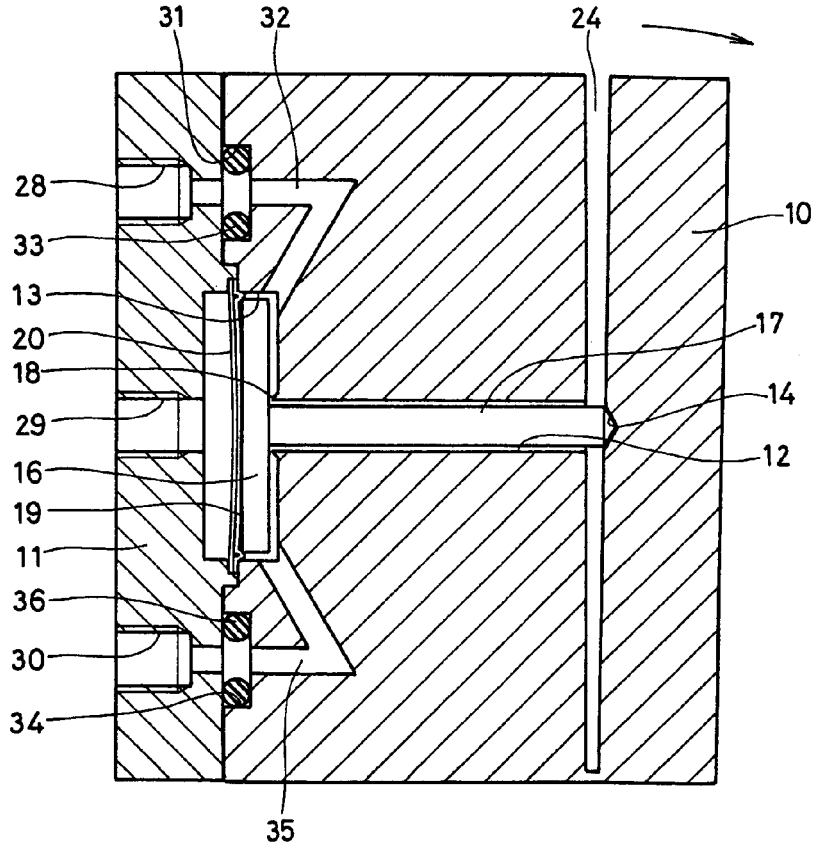
FIG. 8 is a vertical sectional view when the actuator is performing a rotation.

Next, another embodiment will be described referring to FIG. 7 and FIG. 8. This aspect relates to a rotating actuator where a stroke is extracted not in a linear direction but in a rotation direction. The differences from the first embodiment lie in the notche formed in the body 10. In other words, whereas there were four notches 21, 22, 33, 24 formed in the first aspect, in this aspect only the last notch 24 is formed, and turning is performed around the connecting part of the end of this notch 24.

When a signal pressure is applied to the surface of the diaphragm 19 opposite to the pressure plate 16, the rod 17 displaces to the right-hand side in the throughhole 12 according to this signal pressure, and as the contact abutting part 14 is thereby pressed in a part which lies further to the right than the notch 24, the tip side (right side) part turns about the connecting part of the notch 24 as center. The balance of forces at this time is identical to that of the first aspect, and is identical to the theory from Equations (1)–(8). Therefore, according to this aspect, an actuator can be provided which can perform fine angular rotational positioning.

The invention has been described in the case of the embodiments or aspects shown in the drawings, but the invention is not limited to these aspects, various modifications being possible within the scope and spirit of the appended claims. For example, in the aforesaid aspect, the rod 17 was disposed in a horizontal direction so that it was not affected by gravity, and the disk spring 20 was used to prevent displacement of the diaphragm 19 in a radial direction, but if the diaphragm 19 does not displace in a radial direction, the disk spring 20 may be omitted. Also, the actual shape of the body 10 and position or number of the notches 21–24, may be modified as desired.

The present application is based on, and claims priority from Japanese Application Number 2004-307388, filed on Oct. 21, 2004, the disclosure of which is hereby incorporated by reference herein in its entiety.

What is claimed is:

1. An actuator, comprising:

a body having a throughhole with an abutting tip, a notch formed to cut across the throughhole, and a depression communicating with the base end of said throughhole, a pressure plate housed and supported in said depression, a rod installed in said pressure plate and inserted into said throughhole, a diaphragm sealing said depression in contact with an opposite end face relative to an end face on which said rod of said pressure plate is provided, and a nozzle installed in a communicating part with said depression of said throughhole so that the end face of said pressure plate on which said rod is installed, acts as a flapper, wherein:

a tip side part of said throughhole of said body displaces due to an elastic deformation of said notch part when an input pressure is applied to said pressure plate via said diaphragm while a supply pressure is being applied to the interior of said depression.

2. The actuator according to claim 1, wherein the depression sealed by said diaphragm is further covered by a cover body.

3. The actuator according to claim 1, wherein a disk spring is disposed so that it is superimposed on said diaphragm, and an elastic restoring force is generated in the axial direction of said rod by said disk spring.

4. The actuator according to claim 1, wherein plural notches are formed in said body, said plural notches on both sides in the axial direction relative to the midpoint of the rod being in a mutually symmetrical positional relationship so that displacements in a direction which intersects with the axial direction of the rod cancel each other out.

5. The actuator according to claim 1, wherein an even number of notches are formed in said body, and the displacement of said rod in the axial direction is extracted.

6. The actuator according to claim 1, wherein an odd number of notches are formed in said body, and the rotational displacement due to turning in a part containing one or more of these plural notches is extracted.

* * * * *